US006233787B1

(12) United States Patent
Eriksen et al.

(10) Patent No.: US 6,233,787 B1
(45) Date of Patent: May 22, 2001

(54) FIBER DISTRIBUTOR

(76) Inventors: Marianne Etlar Eriksen, Dr. Margrethesvej 4B, 1, DK-8200, Aarhus N (DK), 8200; Carsten Andersen, Teglbaekvej 15, DK-8361, Hasselager (DK), 8361

( * ) Notice: Subject to any disclaimer, the term of this patent is extended or adjusted under 35 U.S.C. 154(b) by 0 days.

(21) Appl. No.: 09/284,851

(22) PCT Filed: Dec. 23, 1998

(86) PCT No.: PCT/DK98/00581

§ 371 Date: Apr. 22, 1999

§ 102(e) Date: Apr. 22, 1999

(87) PCT Pub. No.: WO99/36623

PCT Pub. Date: Jul. 22, 1999

(30) Foreign Application Priority Data

Dec. 23, 1997 (DK) ..... 1520/97

(51) Int. Cl.[7] ..... D01G 25/00

(52) U.S. Cl. ..... 19/306; 19/296; 425/82.1; 425/83.1

(58) Field of Search ..... 19/296, 301, 303, 19/304, 305, 306; 198/689.1; 425/80.1, 82.1, 83.1

(56) References Cited

U.S. PATENT DOCUMENTS 2,676,694 * 4/1954 Wyss et al. ..... 198/689.1
3,252,186 * 5/1966 Oja ..... 19/305
3,508,301 * 4/1970 Brown ..... 19/296
3,581,706 6/1971 Rasmussen .
4,060,360 * 11/1977 Tapp ..... 425/83.1
4,112,549 * 9/1978 Min et al. ..... 19/304
4,264,289 * 4/1981 Day ..... 425/83.1
4,351,793 * 9/1982 Day ..... 19/304
4,640,810 * 2/1987 Laursen et al. ..... 425/83.1
4,650,409 * 3/1987 Nistri et al. ..... 19/304
4,847,022 * 7/1989 Bold ..... 425/83.1
5,471,712 * 12/1995 Kroyer ..... 19/304
5,558,832 * 9/1996 Noel et al. ..... 425/83.1

FOREIGN PATENT DOCUMENTS 0 159 618 10/1985 (EP) .
0 262 898 4/1988 (EP) .

* cited by examiner

*Primary Examiner*—John J. Calvert
*Assistant Examiner*—Gary L. Welch
(74) *Attorney, Agent, or Firm*—James Creighton Wray; Meera P. Narasimhan

(57) ABSTRACT

An apparatus for uniformly distributing a disintegrated material on a fiber layer forming surface comprising a cylindrical housing having a perforated plane-surfaced bottom wall; an inlet opening for a stream of air containing suspended fibers and a stirrer having impellers rotating a short distance above the perforated bottom wall.

20 Claims, 15 Drawing Sheets

FIBER DISTRIBUTOR

BACKGROUND OF THE INVENTION

The present invention relates to a forming box to be used by dry forming of a fibrous tissue and encompassing an inlet for introduction of a fibre material which has been splitted up and chosen from amongst synthetic fibres and natural fibres and which is mixed into an airstream, and which forming box contains several revolving rollers, which are provided with radially placed spikes.

Various instruments of this type are known, for instance from the description of European Patent Application 0 159 618. The forming box in such a known plant will frequently be a part of the instrument, which makes an essential limitation for the capacity of the whole instrument.

In respect to the placing of the fibres on the underlying forming wire the forming box is provided with a bottom in form of a net or a sieve in the form of a bottom with a number of openings. In order to promote the passage of the fibres to the bottom of the forming box in the intention of achieving an increase of capacity the application of various mechanical elements has been proposed in form of wings and rollers or other scraping or brushing devices, which in an active way lead the fibres to the bottom of the forming box. Although such mechanical devices do give an increase of the capacity attempts have been made through many years to increase the capacity further.

The elaboration of meshes or openings in the bottom of the forming box has been decided from the fibres, which are used for the preparation of the fibrous tissue. There has primarily been some talk of using cellulose fibres in the manufacturing of paper products or nappy products. Thus, there has been a limitation of the length of the applied fibres. In practice it has thus not been possible to use fibres of lengths of more than 18 mm. This has simultaneously implied that there has been a limitation in the type of products that can be manufactured with such an instrument.

SUMMARY OF THE INVENTION

It is the aim of the present invention to show an instrument of the type mentioned in the beginning, which remedies the drawbacks by the known technique, because there is achieved a substantially bigger capacity and the possibility of application of long fibres for the forming of the fibrous tissue.

According to the present invention this is achieved by a forming box, which is unique by having an open bottom for the releasing of fibre material on the forming wire, because the spikes are arranged to partly holding back the fibres against the effect from the suction of the vacuum box.

It has surprisingly been shown that it is possible to manufacture the forming box with an open bottom. The cloud of fibres, which has been formed inside the forming box of single fibres, which are split up and mixed in the air stream, are transferred down onto the underlying wire by application of the rotating spike rollers. In practice it has been revealed that with an instrument according to the invention capacities can be achieved which are 5–6 times bigger than the capacity with corresponding known instruments.

By running the instrument the raw fibres are split up. This can take place in hammer mills or its like. Hereafter the divided fibres which still can contain a few agglomerates are transferred by means of an air stream down onto the system. The air stream is created by means of transport blowers, which are linked with pipes that lead to the forming box. In the forming box the fibres are primarily led in from each side of the forming box and possibly be means of more inlet pipes on each side of the forming box. It is hereby possible to vary the capacity by opening and closing the supply pipes and the supply blowers.

Inside the forming box a cloud of fibres is formed, where the fibres can circulate because of the transport air. The fibres will hereafter be transferred out from the bottom of the forming box and take place on the forming wire, which is moving beneath the forming box. The layer of fibres, which is formed on the forming wire is fixed by means of a vacuum, which is established in the vacuum box, which is under the forming wire in a position opposite to the forming box.

The present invention brings about a forming box with an open bottom, where a partly retention and distribution of fibres is taking place against that suction which is carried out of the vacuum box. This retention and distribution is established by the rotating spike rollers, because the spikes are influencing the fibres. It has hereby surprisingly been shown that a tissue is formed with a very homogeneous thickness on the underlying forming wire. Hence it can be said that the rotating spikes form a movable bottom or active bottom which is to be differentiated from the traditional passive bottoms consisting of a piece of a net or sieve.

The spike rollers will principally have an extension as seen horizontally so that they for practical purposes cover the sectional area of the forming box. However, it has been demonstrated possible to manufacture forming boxes which function satisfactorily, although the spike rollers do not cover the whole sectional area of the forming box.

It is possible to place rollers or axles, on which the spikes are formed with an almost horizontal orientation or with an almost vertical orientation. It is supposed that an orientation with an angle between horizontal and vertical also is possible and can give satisfactory results.

By orienting the rollers or axles horizontally or vertically the spikes will rotate in a vertical plane and a horizontal plane, respectively. This is preferred because of the symmetrically laying down of fibres, so that a tissue with homogeneous thickness is formed over the width of the forming box.

In the present application the term spikes will cover an embodiment with largely thread-formed spikes. However, the issue will also cover plate-formed elements, which also can be designated as wings. Such plate-formed wings will primarily be formed with the expanse placed in a plane orthogonally on the rotation axis of the axle. Alternatively the plates can be formed with a slope or be formed like propellers to bring about an upwards or downwards directed action on the fibre cloud. To facilitate the passage of air to the forming head when wing-formed spikes are applied, the wings can be provided with holes. Such holes can facilitate the passage of air. By appropriate choice of revolving speed and form of holes in the rollers the passage of fibres to such holes can be hindered or limited.

The rotating spike rollers can be placed so that the outer ends of the spikes describe circles that overlap each other or just touch each other. Furthermore, it is possible to vary the intensity of the placing of the spikes in the enveloping direction as well as in the longitudinal direction. By means of these parameters and the number of revolutions for the spike rollers and the air stream it is possible to adjust the capacity of the instrument.

According to the invention the forming box is able to handle very long fibres. The fibre length will not be limited by sizes of meshes, sizes of openings or its similar in the bottom of the forming box. In practice it has therefore been demonstrated possible to handle fibres with lengths of up to 60 mm, and correspondingly it has been demonstrated possible to handle different types of fibres. It is supposed that by further optimisation of the forming box according to the invention it is possible to handle fibres which are even longer. It is thus possible to use the instrument for manufacturing of products which until now not have been possible with a similar type of instrument.

Because of the capacity of the instrument and the possibility of the handling of very long fibres it will be possible advantageously to use the instrument for manufacturing of fibrous layers with a substantial thickness, which for instance can be of the size of order of up to 200–300 mm. It will thus be advantageous to use the instrument for manufacturing of fibrous tissue in form of isolation mats as a new area for air-laid, non-woven products. By the manufacture of these mats very long fibres can be used, which can be synthetic fibres or natural fibre or mixtures hereof. As these fibres can have a substantial length, it will be possible to create a form stable tissue, although it is manufactured with a big thickness. The long fibres can form fibrous bindings over a relatively big layer of material. The bindings can be crispy hydrogen bindings or elastic bindings, which are established by means of binding material or a combination hereof.

It has surprisingly been shown possible to manufacture the products with an improved quality relatively to known products. In products, which are manufactured in an instrument according to the invention, it has thus been shown possible to avoid so-called shadows and agglomerates, which consist of gathered fibre lumps in the product. It is thus surprising that it by means of the instrument has been possible to hold the fibres separated from each other. It is anticipated that this disintegration of agglomerates of a fibrous material is due to influences from strokes that the fibres are exposed to when they by means of the spikes of the rollers are struck upwards in the forming box or downwards against the underlying forming wire.

It has thus been shown possible to form a fibrous product, where problems are avoided with the variation of the thickness over the width of the product, which is formed on the forming wire. It is anticipated that this surprising homogeneity of the thickness of the created product over the width of the product is due to fact that the rotation of the spike rollers leads the fibres directly down against the forming wire in the direction orthogonally on the surface of the forming wire. This homogeneity is achieved, although forming wires with widths of 200 mm to several meters are applied.

As mentioned earlier, the instrument is advantageous because the capacity of the forming box can be adjusted. Hereby the capacity of the instrument can be adjusted dependent of the product which is to be formed, and dependent of the transferring rate, which it is possible to apply for the forming wire without a risk that the formed tissue is blowing away.

The adjustment can in a forming box with horizontally oriented rollers primarily be effected by mounting the rollers mutually displaceable in a substantially horizontal plane and can be placed with a mutual distance, which approximately corresponds to the diameter of the circle, which defines the outer ends of the spikes or is less. It is thus possible to establish clefts, which allow a bigger amount of fibre material to pass within a given unit of time.

When the horizontally oriented rollers are shifted horizontally, so that the outer ends of the spikes are transferred in-between each other, it becomes possible to manufacture a fibrous tissue of very short fibres, for instance with lengths of down to 3 mm. Hereby it becomes possible to achieve a very homogeneous product with a very homogeneous profile in the sectional direction as well as in the longitudinal direction. It is also possible to handle the short fibres, although only a single layer of rollers in the forming box is applied. As mentioned beneath it will also be possible to use more layers of rollers placed above each other in the forming box.

If the forming box is to handle long fibres, for instance with a length of 60 mm or more, it will be advantageous to shift the rollers, so that the circles which define the outer ends of the spikes substantially just touch each other or are a little shifted from each other.

When the spikes of the rollers are arranged to describe overlapping curves the instrument is unique by having the spikes in the longitudinal direction of the rollers with a mutual distance which allows passage in-between for corresponding spikes on an adjacent roller. In respect to a little change of capacity for an instrument it is also preferred that the spikes are placed in shiftable rails which are mounted in axial trails in the roller.

The spikes on each roller will primarily be placed orthogonally on the longitudinal axis of the roller, and over the length of the roller is placed a number of set of spikes. Each of these sets will substantially contain 2–12 spikes and especially 4–8 spikes, which are evenly distributed along the circumference of the roller.

It is possible to use very varying dimensions and revolving rates. It is, however, preferred that the axial distance between the spikes is between 5 and 20 mm, and that the thickness of the spikes is between 0,5 and 10 mm. The length of the spikes will be between 5 and 200 mm, preferably about 100 mm. The rollers are arranged with a variable number of revolutions, which can be regulated, so that it will be within an interval of between 200 and 5000 r.p.m., preferably about 2300–2500 r.p.m.

It will also be possible to use numbers of revolution, lengths of spike and thicknesses of spike, which lie outside these intervals. By varying the length and the thickness of the roller and spikes it is likewise possible to handle long fibres without the risk that they spin into each other. That is, it will be possible to handle the long fibres and get these down on the forming wire as individual fibres, without being spun into each other.

In order to arrange the forming box with horizontally oriented rollers for handling of fibres with various abilities it is possible to provide more layer of rollers. The rollers in each layer can be placed on a row with their longitudinal axis oriented parallelly or orthogonally on the movement direction of the forming wire. The longitudinal axis of the rollers can, however, also be oriented in the direction parallel with the movement direction of the forming wire. By having more layers of rollers on top of each other it is thus possible to achieve an opening of fibres, which otherwise would be difficult to open.

It is also possible to place the rollers in the various layers with different orientation in relation to the rollers in one of the other layers. By applying more layers of rollers it is possible to handle relatively short fibres and at the same time maintaining a big capacity.

When the rollers are placed horizontally they can be arranged so that a substantially hollow cylinder is formed within the forming head. This cylinder is formed because the rollers are brought about within a cylinder expanse, so that a hollow cylinder is formed where the inlet for the fibres is provided on an ending expanse. The fibres are thus transferred into the hollow cylinder, which is formed by the rollers with the placed spikes upon it.

Mainly at least one further roller will be provided, which similarly is provided with spikes and which is arranged within and adjacent to the formed cylinder wall. This allows the fibres to, which are blown into the hollow cylinder, and which can form a border or sausage by the influence of the rotating spikes upon the fibres, in a sure way be distributed along the length of the cylinder. Because the cylinder mainly will be arranged with an extension orthogonally on the direction of transference for the forming wire it will thus be possible to form a fibrous tissue with a very homogeneous thickness across the width of the forming wire.

The spikes upon the rollers in the cylinder expanse or the further roller within the cylinder can be established with such a length that the circumscribed circle which is defined by the outer end of the spikes, substantially touch each other or are slightly overlapping.

Preferably, there will be more cylinders provided. The cylinders will in especially advantageous embodiments be established in pairs, so that the inlets to a cylinder pair are established in opposite sides to the side wall of the forming box. Moreover the ends of the cylinder can be linked with linking channels, which go through the side wall of the forming box, and which allow the fibres to pass from the inner of a cylinder to the inner of an adjacent cylinder. Hereby can be achieved a rotation of fibres in a substantially circle-formed curve through two adjacent cylinders and the linked linking channels. This gives a good mixture and an even distribution of fibres.

In a forming box more paired cylinders or single cylinders can preferably be established, which are linked with separate supply sources of fibres. Hereby it becomes possible to form a tissue with varying fibre abilities with respect to the thickness. In a forming box three pair of cylinders will preferably be placed where the first and the terminal cylinder pair are provided with fibres, which are to be outerlayer in the formed fibrous tissue, and where the central cylinder pair is intended to form a in-between layer within the formed tissue. Such a construction is suitable for manufacturing of tissue, which is used by the manufacturing of nappies, towels and its like, where a core of hydrophilic material is formed surrounded by an outerlayer of hydrophobic material.

By placing of more paired or single cylinders within a forming box it is also possible to increase the thickness of the formed tissue, because identical fibres can be used in all cylinder pairs or single cylinders.

If the rollers are oriented substantially vertically the spikes will preferably be established with a form of substantially expanse-formed wings, which are in one plane, being approximately perpendicular on the longitudinal axis of the rollers. The wings/the spikes will preferably be established within one single layer, but two or more layers on top of each other can also be established. The wings/the spikes will preferably be established in various levels, so that an overlapping is established, where the spikes/the wings from one roller will be established in another level than the spikes/the wings from one or more adjacent rollers. Hereby is a risk for collision avoided, if the rollers are not driven synchronously. By synchronic operation of the rollers it will be possible to establish the spikes/the wings in identical planes. This can take place independently of the rollers being horizontally or vertically oriented.

In a forming box with vertically oriented rollers the wings/the spikes can be placed under an angle in relation to a plane perpendicular on the longitudinal axis of the roller. In this situation an overlapping of the described curves can also be established by the rollers alternately being provided with upwards directed spikes and downwards directed spikes, which form approximately the same inclined angle.

It is possible to place more forming boxes after each other in order to increase the thickness of the formed tissue and/or to create a tissue with different types of fibres in various layers.

It has been shown possible that the rollers can rotate around their longitudinal axis with identical or different rates. It has also been shown possible that the rollers can rotate in the same or in the opposite direction.

BRIEF DESCRIPTION OF THE DRAWINGS

The invention will in the following be explained more closely with reference to the attached drawing, where.

DETAILED DESCRIPTION

In the various figures identical or corresponding elements will be designed with the same reference designation and will therefore not be explained in detail in connection with each figure.

Figure 1:
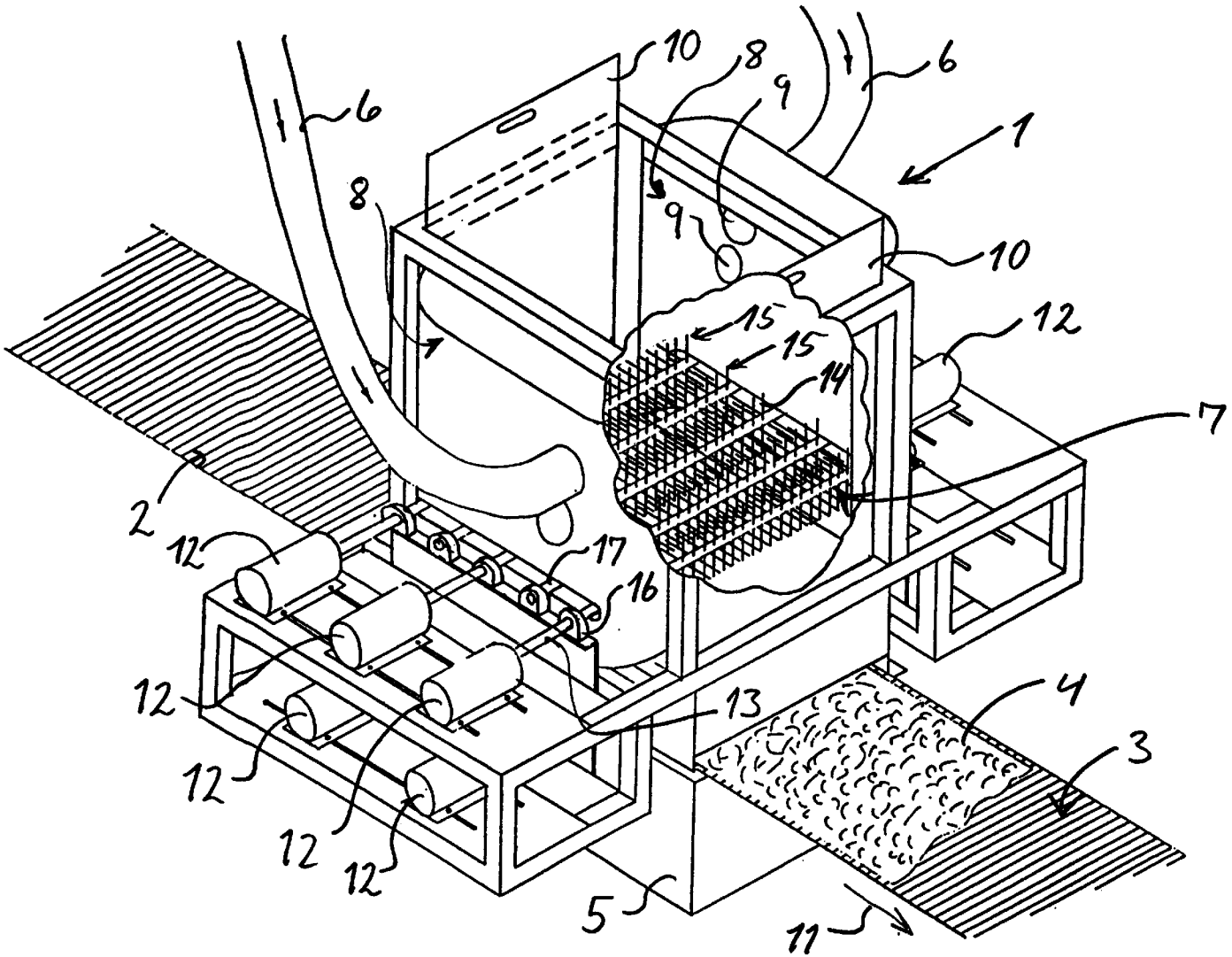
FIG. 1 shows a schematic picture, with certain parts cut away, of a forming box according to the invention.

In FIG. 1 a forming box can be seen according to the invention, which generally is designated with the reference designation 1. The forming box 1 is placed over a forming wire 2. Upon the surface 3 of the forming wire is thus formed a fibrous tissue 4. Beneath the forming wire 3 a vacuum box 5 is placed in a position opposite to the forming box 1. The vacuum box 5 is linked to a vacuum source (not shown).

The forming box 1 is linked to an inlet pipe 6. In the inlet pipes 6 an air stream is blown which contain fibres in the forming box 1 in a position on top of the spike rollers 7. The inlet pipes 6 are linked to garnett devices in form of hammer mills or other equipment, which garnetts a fibre material, so that individual fibres are formed or individual fibres containing very few agglomerates. In the shown embodiment an inlet pipe 6 is shown in each side wall 8 of the forming box 1. As indicated in side walls 8, two inlet openings 9 are, however, placed in each side wall. It will optionally be possible to apply two or more inlet pipes 6 in each of the side walls, dependent of the capacity wanted in the dry forming instrument, in which the forming box 1 is part of.

The fibres which are transferred to the inlet pipes 6 can be any kind of up-splitted airborne fibres that can be chosen from among synthetic fibres or natural fibres or be a mixture of such fibres.

The forming box 1 is not provided with any bottom plate. The forming box 1 has in the shown embodiment no top plate. The forming box has end walls 10, which are arranged shiftable with respect to heights in a direction away from and downwards against the forming wire 3. At least the end wall 10, which is directed against right, is shiftable with respect to heights, in that the fibrous tissue 4 is formed upon the forming wire, when this is transferred in its normal transference direction according to the arrow 11.

The spike rollers 7, which are placed within the forming box, can be said to make up the bottom of the forming box. In the shown embodiment there are altogether placed five spike rollers 7 in the upper layer, in that three spike rollers are placed by one side wall and two spike rollers at the opposite side. Alternatively it will be possible to mount all spike rollers from the same side. However, an alternate mounting of the spike rollers as shown allow for a bigger space between the engines 12, which run the spike rollers. The engines 12 are arranged with the possibility for a variable revolution rate. It is thus possible to adjust the revolution rate of the engines dependent of choice of spike rollers and the product, which is to be formed. In FIG. 1 a lower layer of spike rollers is also shown, which also is placed in a substantially horizontal plane parallel to the forming wire 3.

Each of the spike rollers 7 has an axle 13, upon which spikes 14 in form of thread-formed elements are mounted. The spikes are in FIG. 1 shown mounted on rows axially to the axle 13 and a number of four in the circumference to the spike roller 7. The spikes 14 are established with a size and an mutual distance, which makes it possible to allow for a passage in-between for corresponding spikes 14 on an adjacent spike roller. When the spike rollers are shifted in their planes, it is thus possible for the spikes to penetrate in-between each other, so that the spike rollers 7 can be placed with a mutual distance, where the diameter for the circle, which defines the outer end 15 of the spikes 14, is overlapping the diameter for an adjacent spike roller 7. The mutual shifting of the spike rollers takes place by shifting of the axle house 16 in the mounting rails 17 in each side of the forming box 1.

Figure 2:
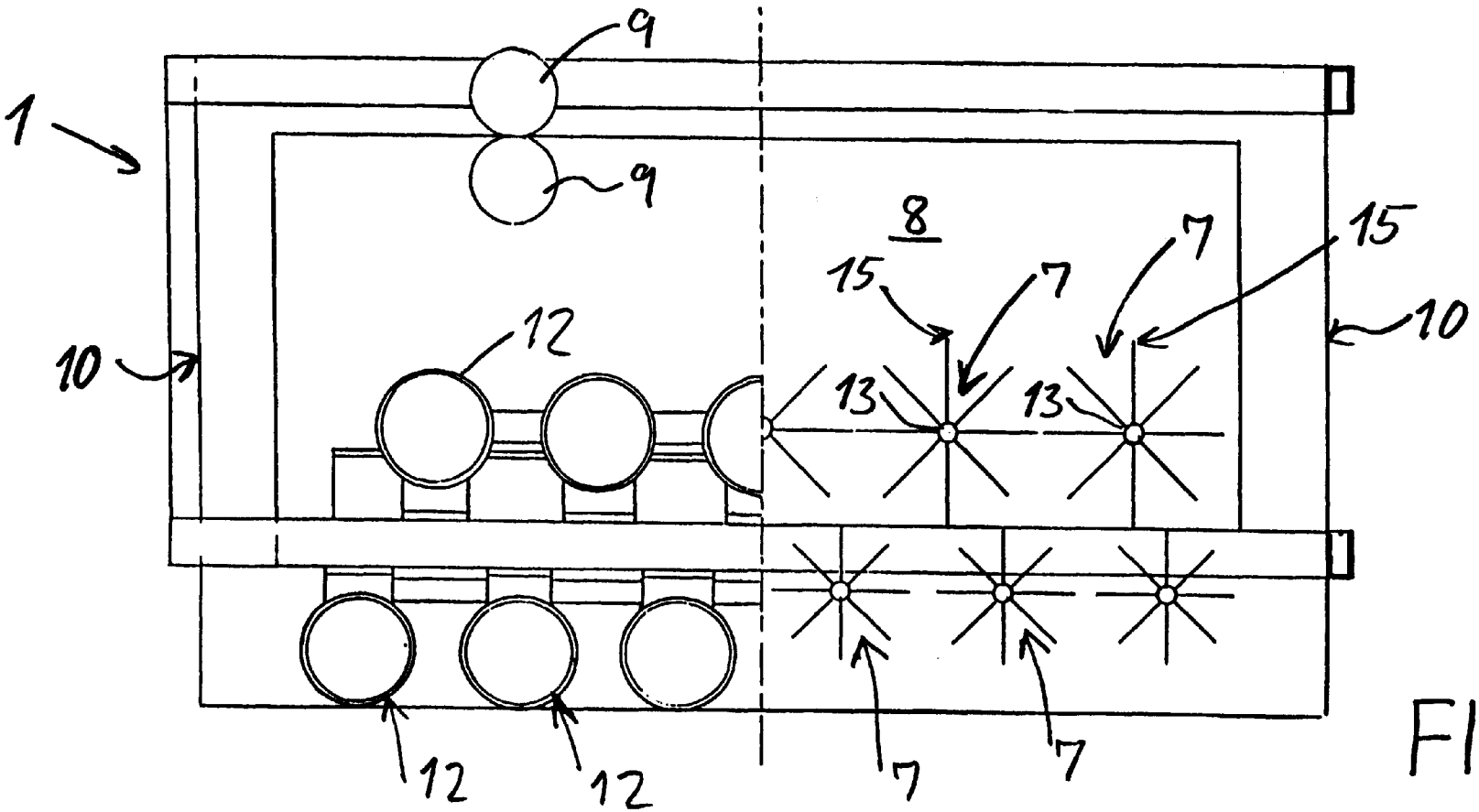
FIG. 2 shows schematic side picture, partly sectionally, of a forming box, as shown in FIG. 1.

In FIG. 2 engines 12 in the left side of the picture are schematically illustrated. In the right side of the picture a partial section is shown for schematically illustrating the spike rollers 7. As it is seen the spike rollers in this embodiment is placed, so that they are in the position shifted in relation to each other in the two layers. Moreover the spike rollers are placed so that the outer ends 15 of the spikes 14 will not overlap the circle, which is described by the outer ends 15 for the spikes on an adjacent spike roller 7.

Figure 3:
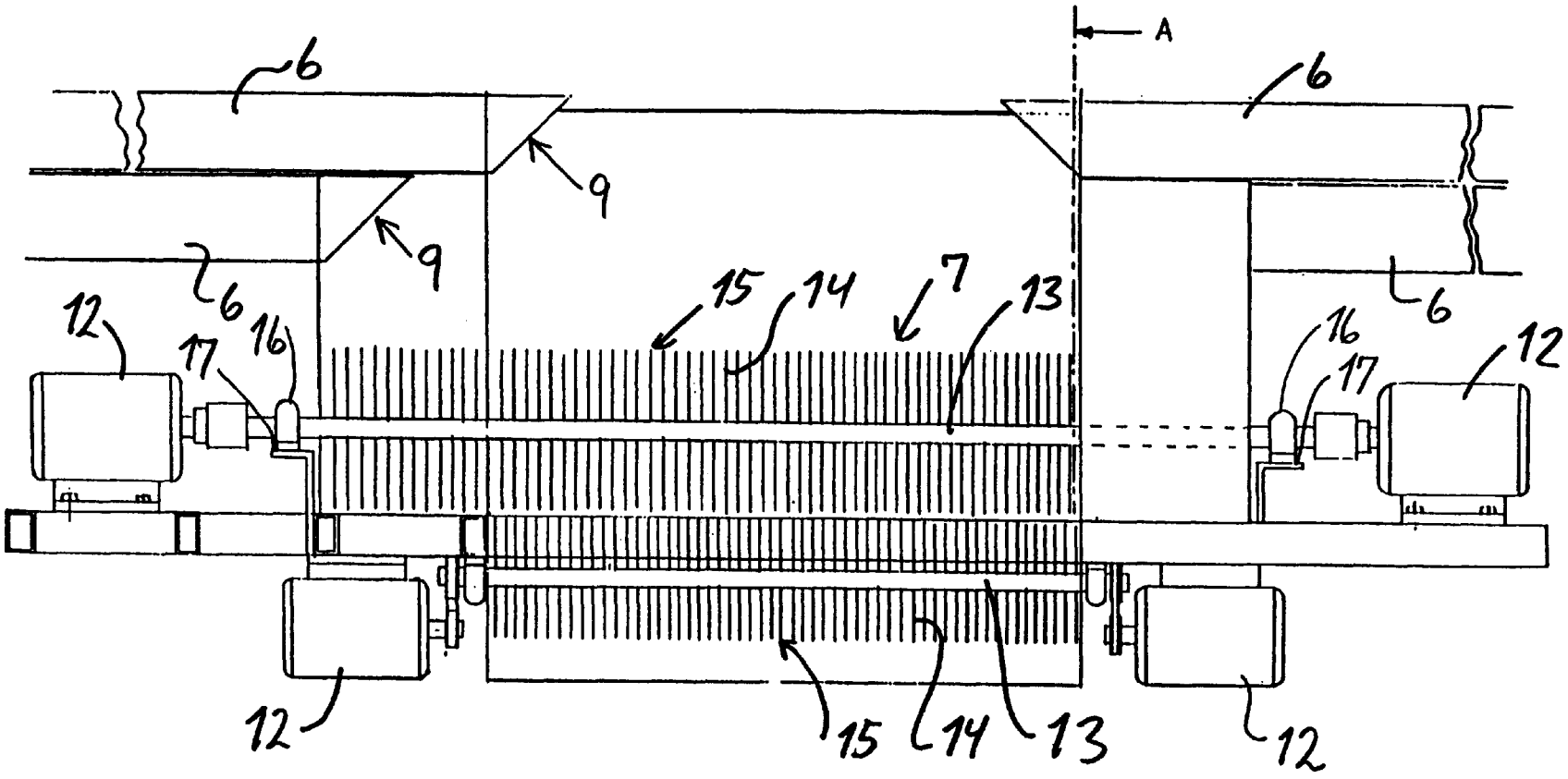
FIG. 3 shows a partial side picture of details of the forming box shown in FIG. 1.

FIG. 3 is a partial side picture of the forming box 1 shown in FIGS. 1 and 2. It is seen here that the two inlet pipes 6 have been applied on each side of the forming box. It is likewise seen that the inlet openings 9 within the forming box need not be in the same vertical plane. As illustrated in the left side the inlet openings 9 of the inlet pipes can be placed in different positions within the forming box to achieve a better distribution of the fibres, which form a fibre cloud on top of the spike rollers 7. It is moreover to be seen that the inlet openings 9 are created in form of inclined cuttings of the pipes, which give a partly downwards directed air stream of fibres.

In FIG. 3 it is furthermore seen that the engines are placed alternately in relation to each other, and that the length of the spike rollers 7 in the two layers need not have the same length. It is also possible to vary the running direction for the spike rollers. The spike rollers can thus be driven with the same revolution direction or with different revolution directions in the same layer as well as in the different layers.

Figure 4:
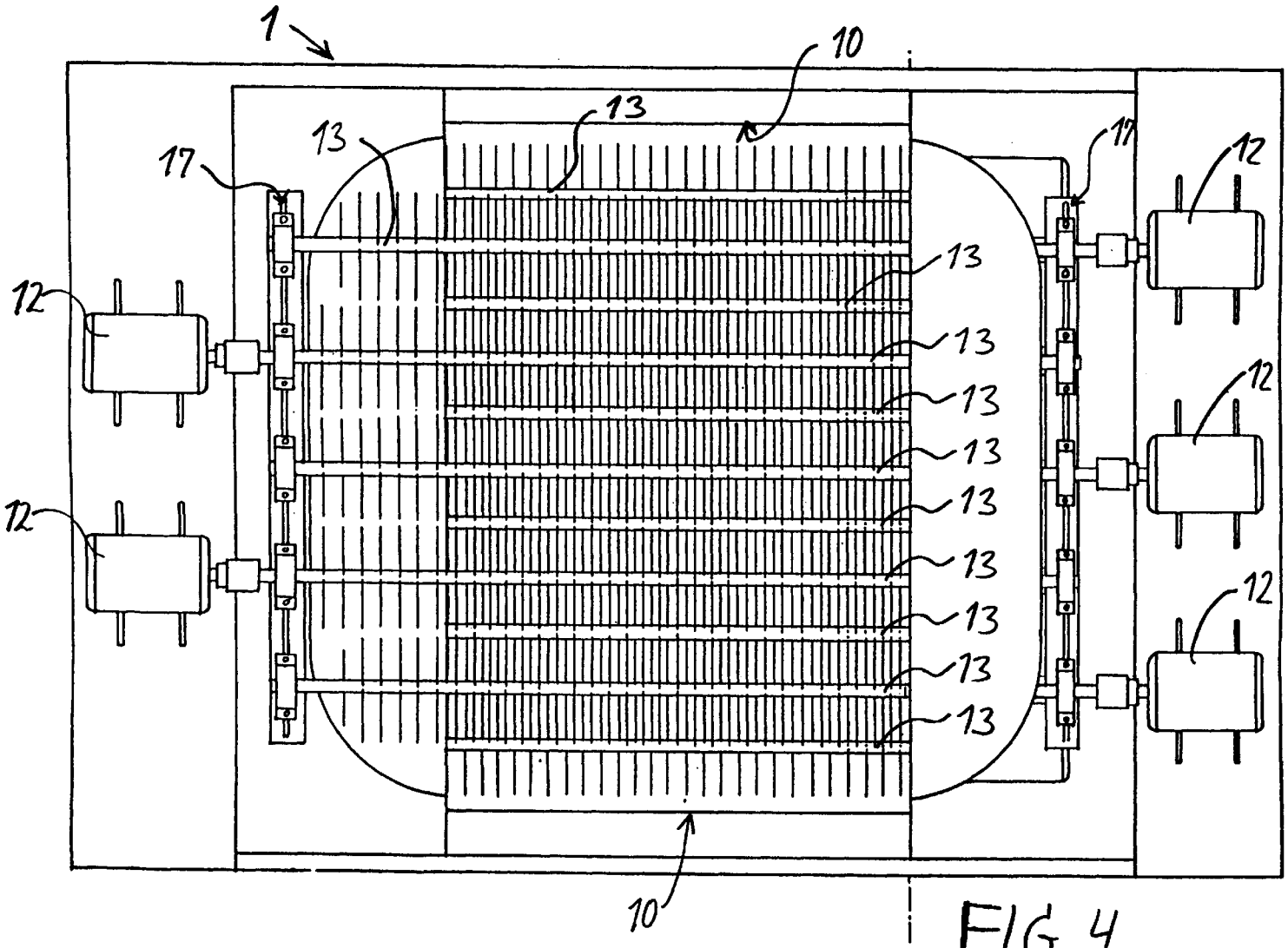
FIG. 4 shows a plane picture with certain parts cut away of the forming box shown in FIG. 1, seen from the top.

FIG. 4 shows a plane picture of the forming box seen from the top. Only some of the engines 12 are shown. It is seen here that the spike rollers 7 in the different layers are shifted in relation to each other, so that the axles 13, as seen from the top, are distributed with substantially the same big distance over the length of the forming box 1.

In the shown embodiments the spike rollers 7 are shown with an orientation perpendicular to the transference direction 11 of the forming wire 3. However, it will also be possible to place the spike rollers 7 with an orientation parallel to the transference direction 11 or with an angle in relation to the transference direction 11. However, it is preferred that the spike rollers 7 are placed as shown in the figures. In practice it has been shown that this orientation of the spike rollers gives a more even distribution of the thickness of layer over the width of the forming wire 3.

Figure 5:
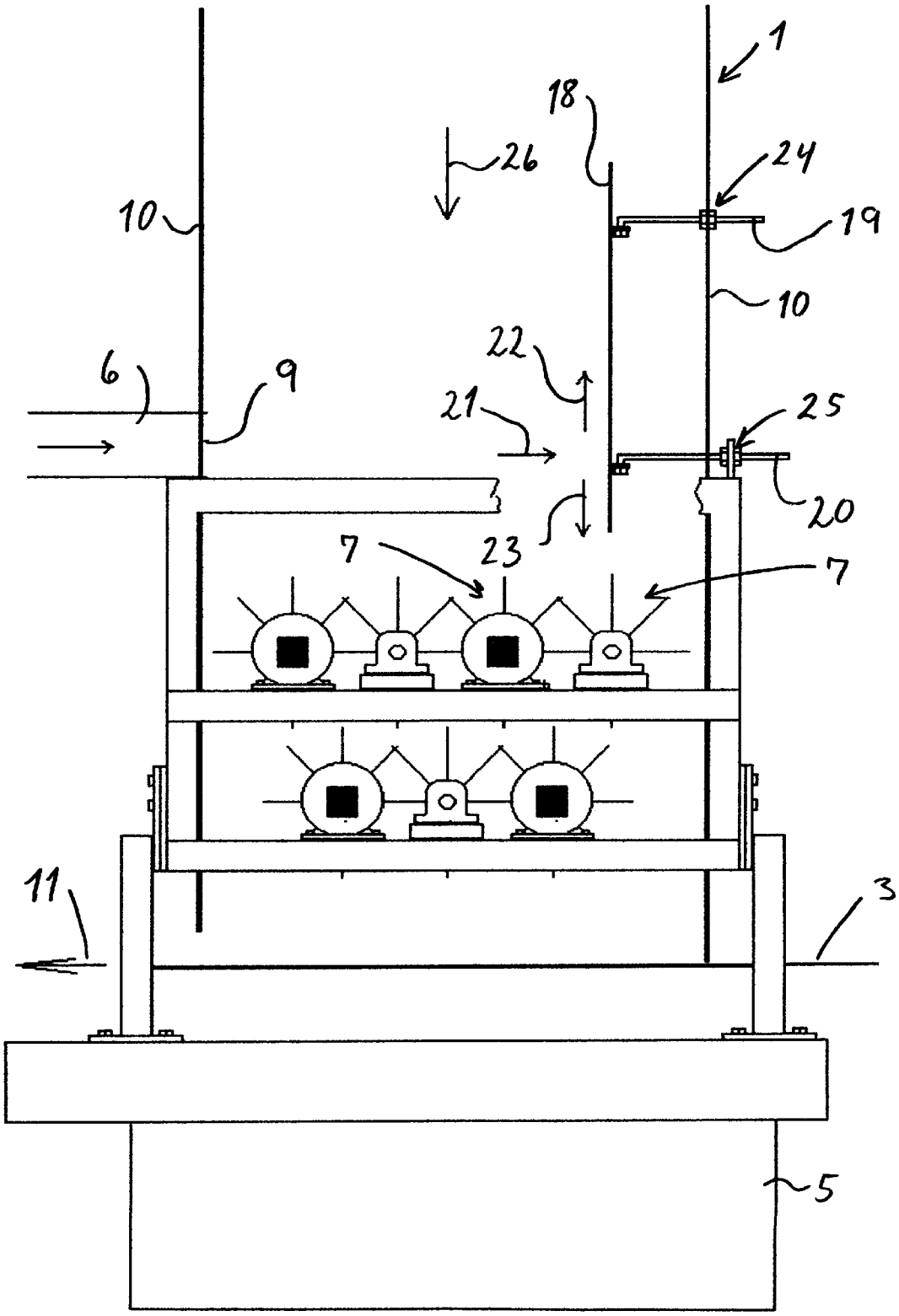
FIG. 5 shows a partial side picture for illustration of a further embodiment of a forming box according to the invention.

FIG. 5 illustrates a side picture of a forming box 1 with horizontally oriented spike rollers 7. In this forming box there is illustrated an inlet pipe 6 in the end wall 10 of the forming box in that side which is directed against the transference or movement direction 11 of the forming wire. The inlet pipe 6 can be established in the opposite end wall 10. Opposite to the inlet opening 9 of the inlet pipe a rebound plate 18 is established. The rebound plate is mounted on adjustable seats 19,20. Hereby the angle of the rebound plate can be adjusted so that an approaching cloud of fibres 21 can be directed substantially upwards according to the arrow 22 or substantially downwards according to the arrow 23. The rebound plate can be adjusted by means of thread connections 24,25. The rebound plate 18 can thus be given an angle position and can simultaneously be established in a shorter or longer distance from the inlet opening 9.

As an alternative to the inlet pipe 6 the fibres can be introduced from the top of an upward open fibre box from the top, as indicated by the arrow 26. In the shown embodiments the inlet openings 9 is indicated as circular openings. However, the transference opening can be an elongated cleft, and the terminal part of the transference pipe 6 can in such a situation have form of a fish tail. Hereby is achieved an introduction of a small fibre cloud 21 with a width which substantially corresponds to the width of the forming box 1.

Figure 6:
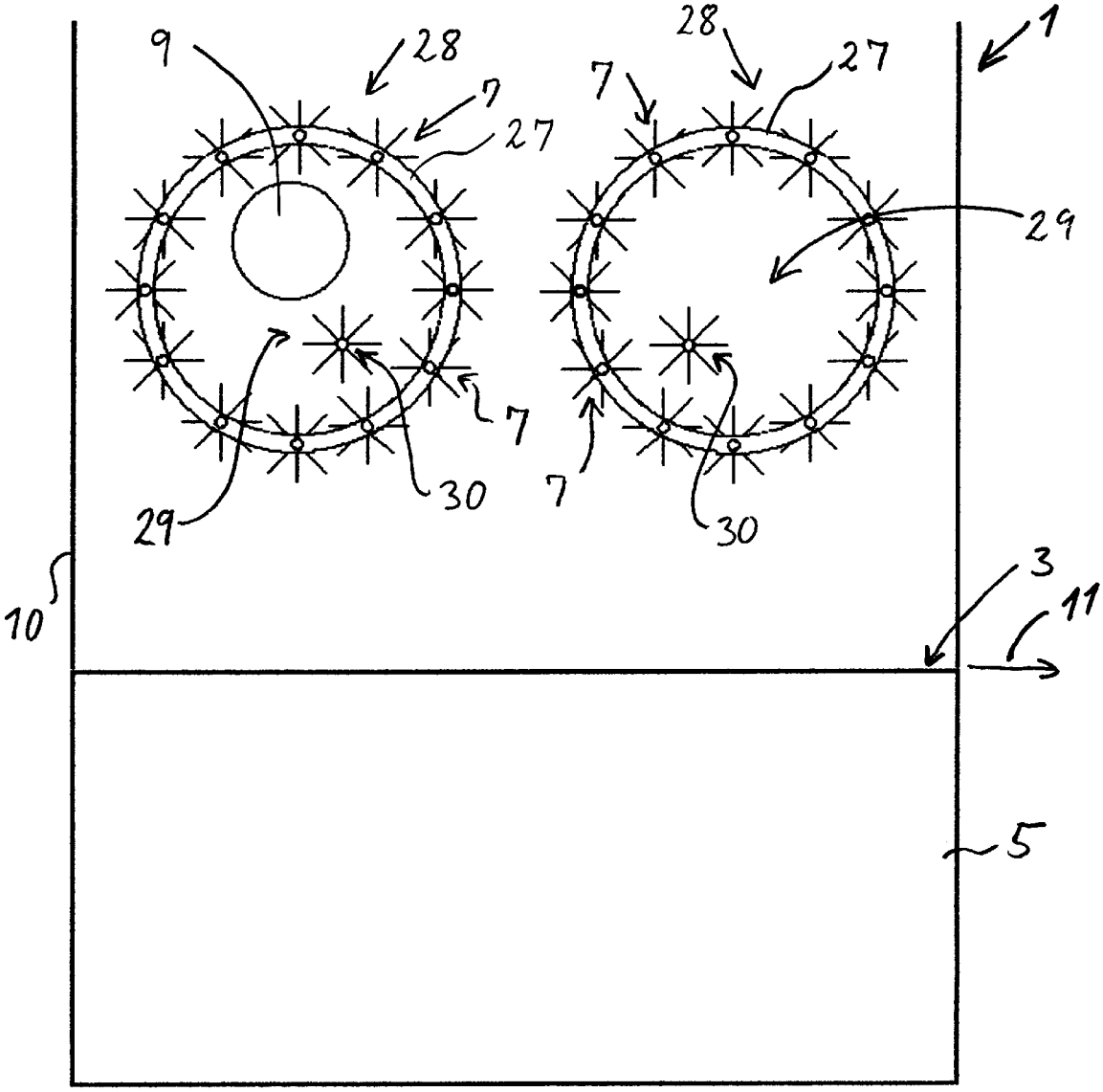
FIG. 6 shows a picture, partly sectionally, seen according to the line VI—VI in FIG. 7 for illustration of a further embodiment of a forming head according to the invention.
Figure 7:
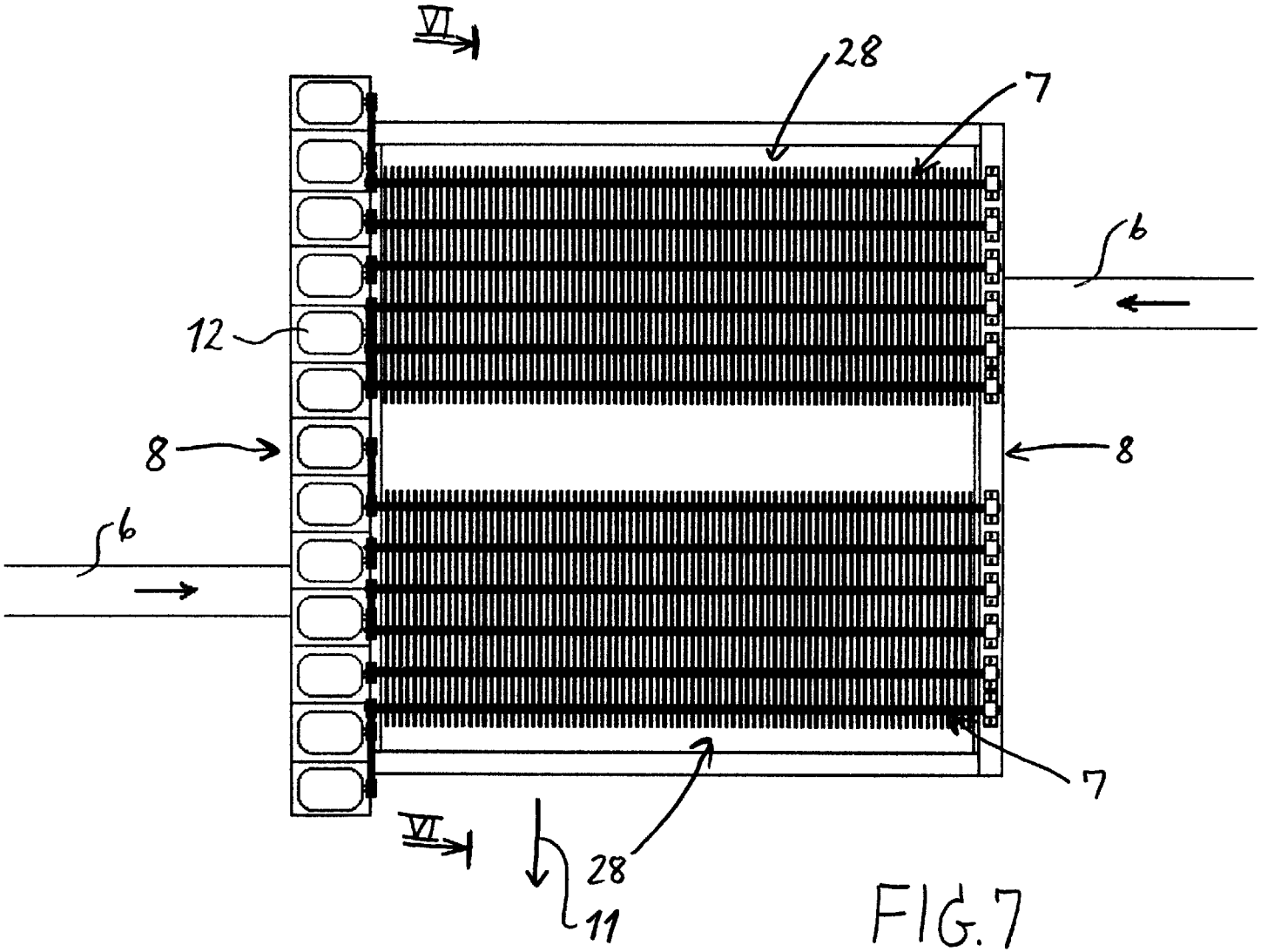
FIG. 7 shows a plane picture, seen from the top, of the forming box shown in FIG. 6.
Figure 8:
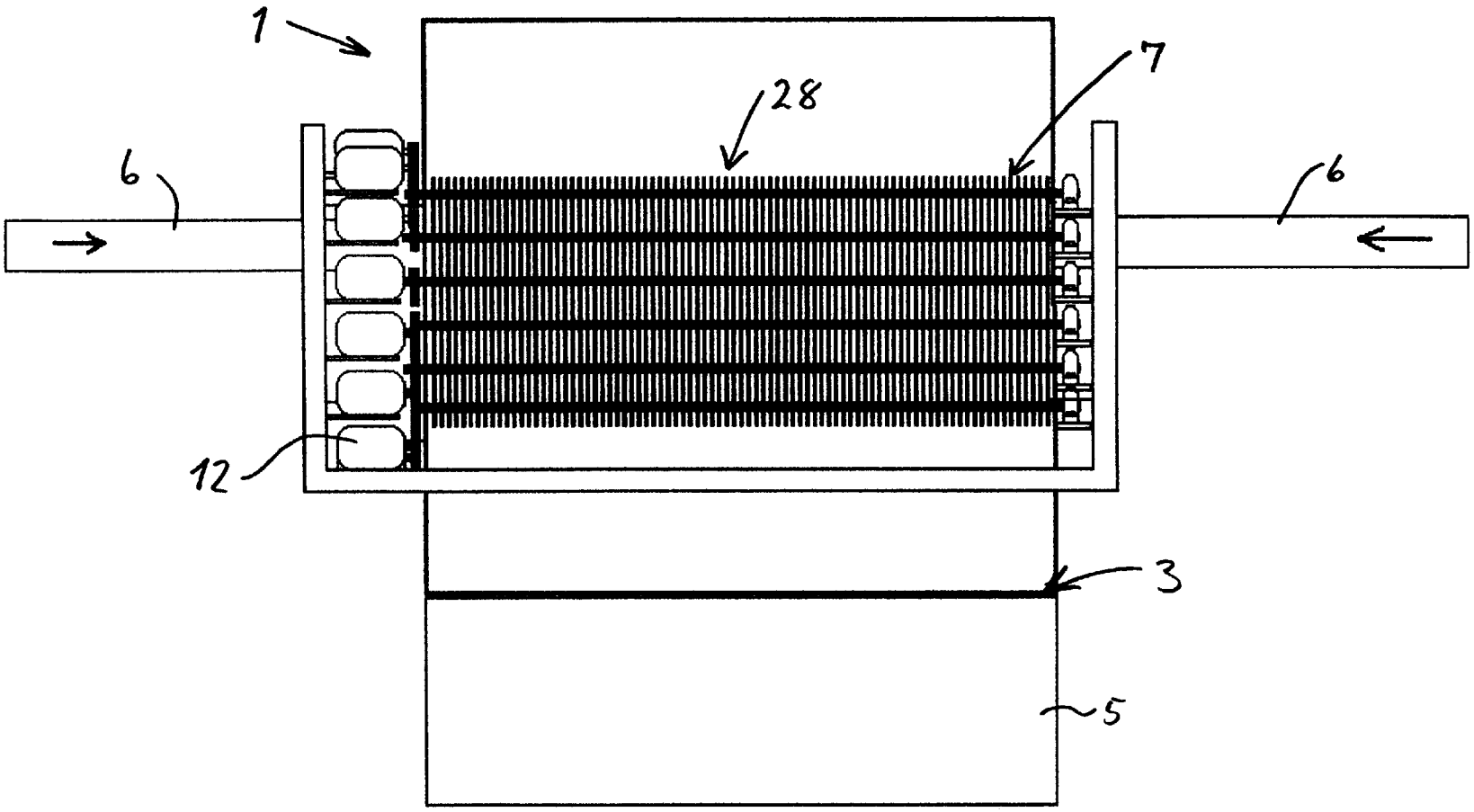
FIG. 8 shows a side picture of the forming box shown in FIG. 6 and 7, FIGS. 9–10 show a picture corresponding to FIGS. 7 and 8 for illustration of a further embodiment of a forming box according to the invention.

FIGS. 6–8 illustrate an alternative embodiment of a forming box 1. In this embodiment substantially horizontally oriented spike rollers 7 are established along two cylinder expanses 27, so that the spike rollers by each cylinder expanse 27 altogether form a cylinder 28 with a movable wall. In the hollow inner part 29 of the cylinder a further spike roller 30 is established. It is established relatively close to the wall of the cylinders 28. Hereby the fibres are influenced so that they are distributed evenly over the length of the cylinders 28. The fibres are blown inwards via inlet pipes 6 through the inlet openings 9, which end in the inner part 29 of the cylinder . In the shown embodiment the inlet pipes 6 are established at the opposite side walls of the forming box 1. Alternatively, both inlet pipes can be established along the same side wall.

Each of the spike rollers 7 can be rotated with the same direction of rotation within a cylinder. Alternatively, the spike rollers can be rotated in different directions of rotation. By different rotation or uniform rotation of the spike rollers it is possible to achieve an orientation of the fibres and thereby a possibility to achieve specific direction determined properties in the formed tissue.

In the shown embodiment two cylinders 28 are established. Alternatively it is, however, possible to have one single cylinder in the forming box 1 only. It is similarly illustrated that the cylinder 28 substantially covers the whole section of the forming box, as it is seen in a horizontal plane. It has appeared, however, that the cylinders 28 only need to cover a part of the sectional area of the forming box in order to achieve a uniform layer thickness in the formed tissue.

Figure 9:
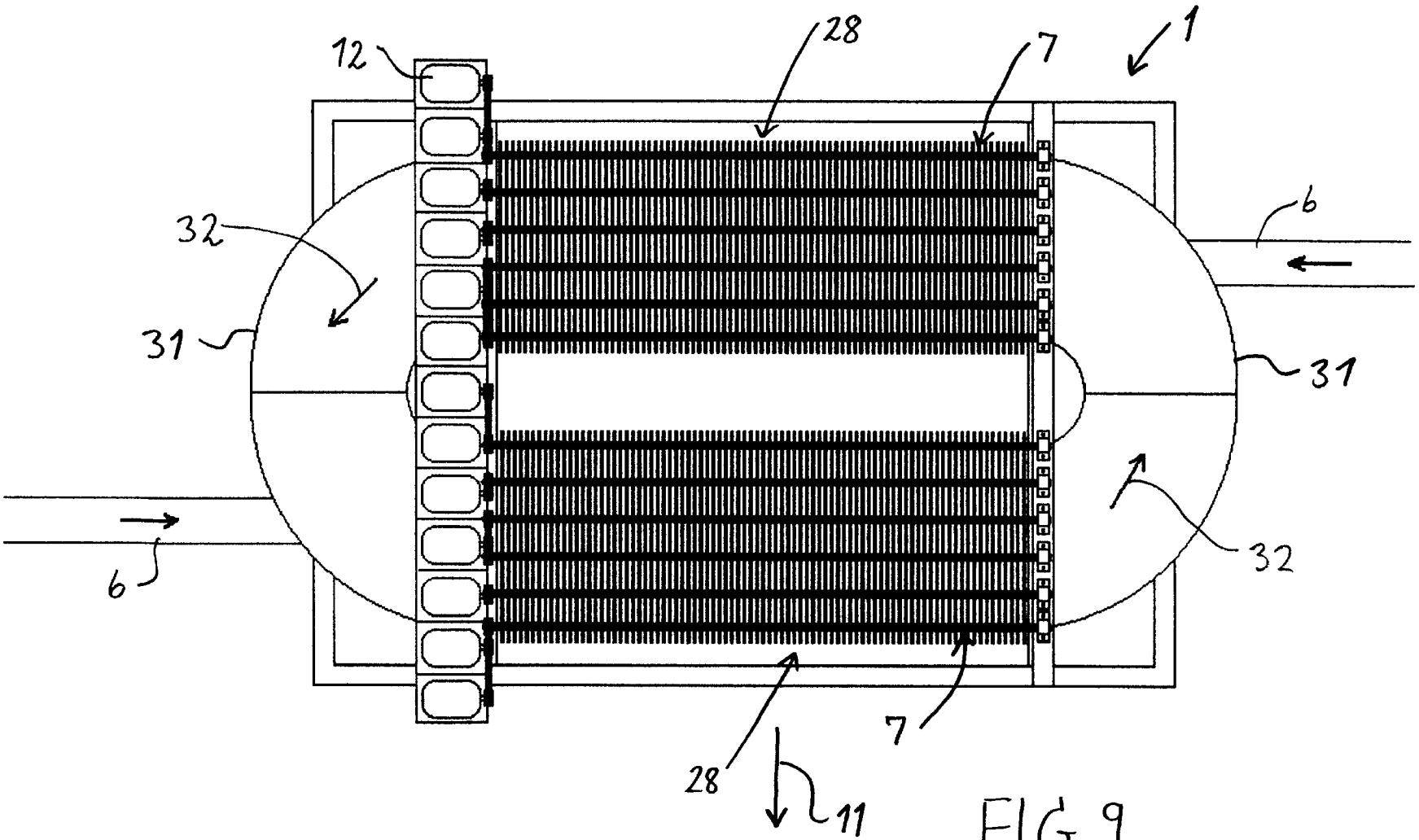
Figure 10:
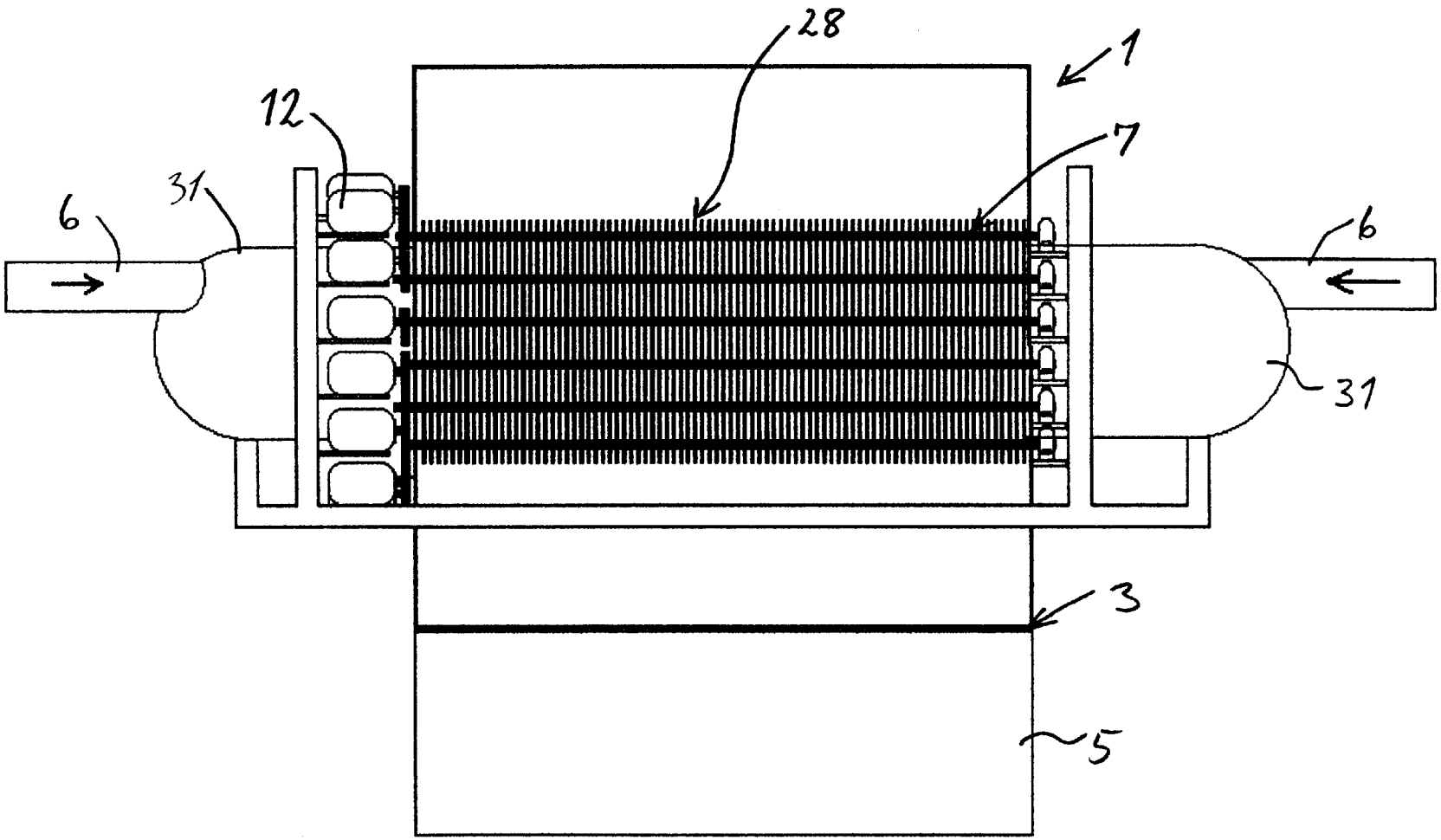

In FIGS. 9 and 10 an alternative embodiment is illustrated corresponding to FIGS. 7 and 8. In this embodiment openings are established by the ends of the cylinders 28 in the side walls 8 of the forming box, and hereby is the hollow inner part 29 between the two adjacent cylinders connected to each other by means of linking channels 31. The linking channels 31 allow that when air blown a fibre cloud is led in a circulated movement according to the arrows 32 from the inner part of the cylinder 28 to the inner part of an adjacent cylinder 28. This gives possibility of achieving a rather uniform distribution of fibres over the length of the cylinders 28 and thereby a uniform distribution of fibres upon the underlying forming wire.

It is to be noted that the spike rollers 7 and the cylinders 28 are established with an orientation substantially perpendicular to the transference direction 11 of the forming wire.

Figure 11:
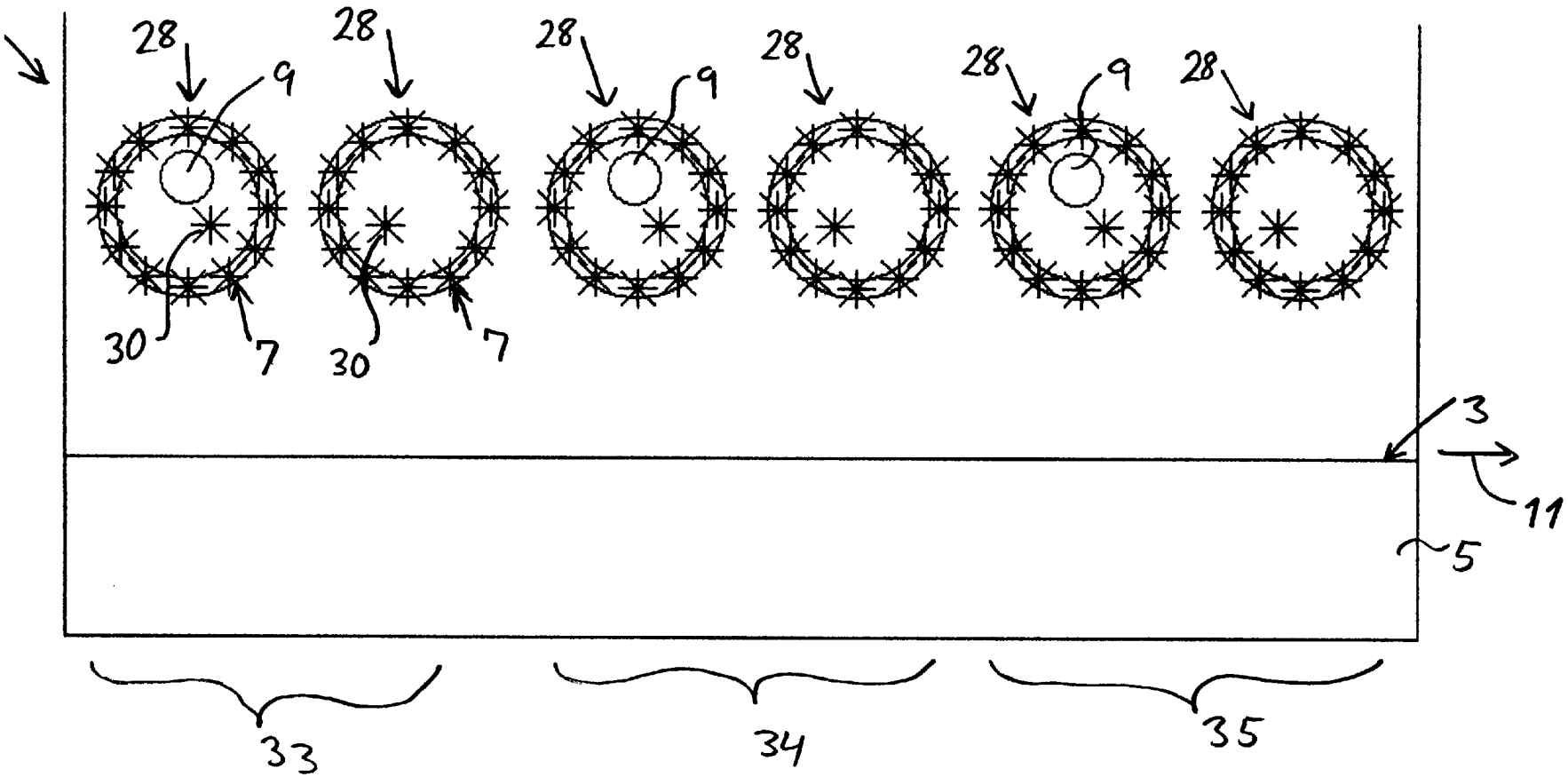
FIG. 11 shows a picture corresponding to FIG. 6 for illustration of a further embodiment of a forming box according to the invention.

In FIG. 11 a picture is illustrated which substantially corresponds to FIG. 6. In this embodiment six cylinders 28 are established. The cylinders are pairwise oriented, as explained with reference to FIGS. 6–10. The cylinders can be established with or without the linking channels 31. The cylinders are pairwise connected with separate supply sources for fibres with different abilities. The first pair of cylinder 33 is connected to a source for supply of hydrophobic fibres, the next cylinder pair 34 is connected to a source for supply of hydrophilic fibres, and the third cylinder pair 35 is connected to a supply source for hydrophobic fibres. An integral tissue is hereby formed, which is suited for manufacturing of nappies, towels, and its like, in which a liquid absorbing core is to be established between the outer layer of hydrophobic material.

Figure 13:
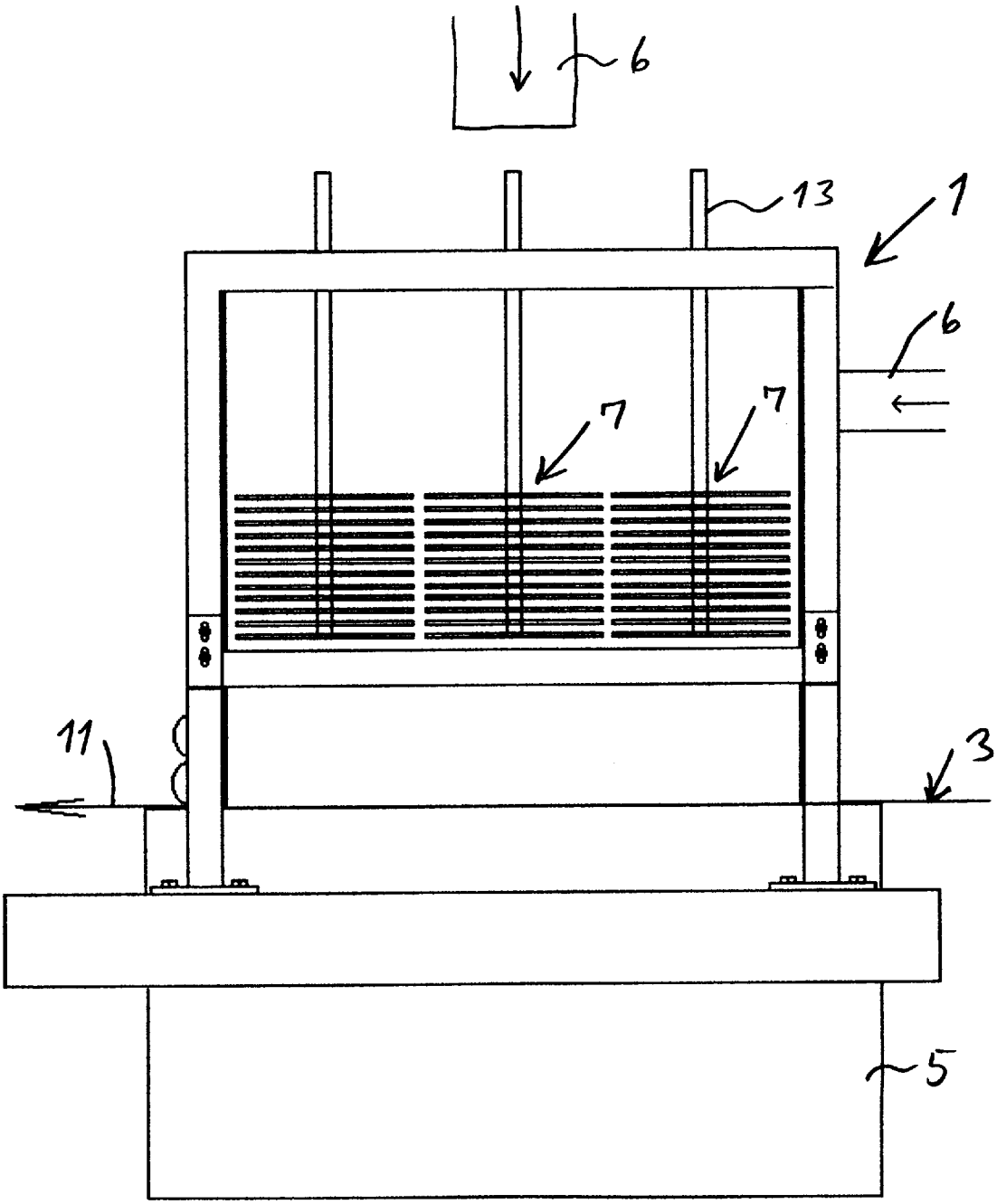
FIG. 13 shows a picture corresponding to FIG. 12 for illustration of a further embodiment for a forming box with vertical rollers.
Figure 14:
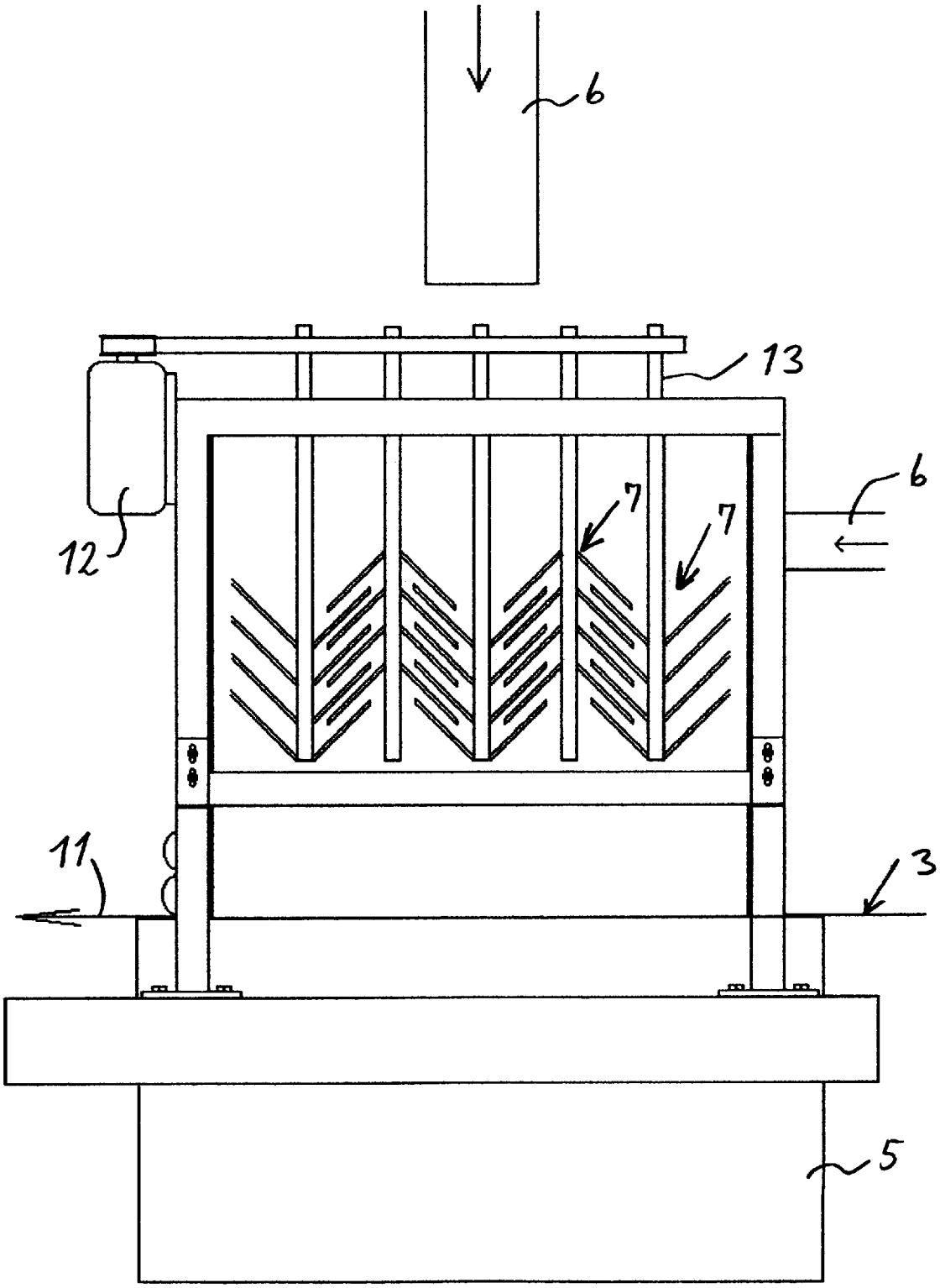
FIG. 14 shows a picture corresponding to FIGS. 12 and 13 for illustration of a further embodiment of a forming box with vertical rollers.
Figure 15:
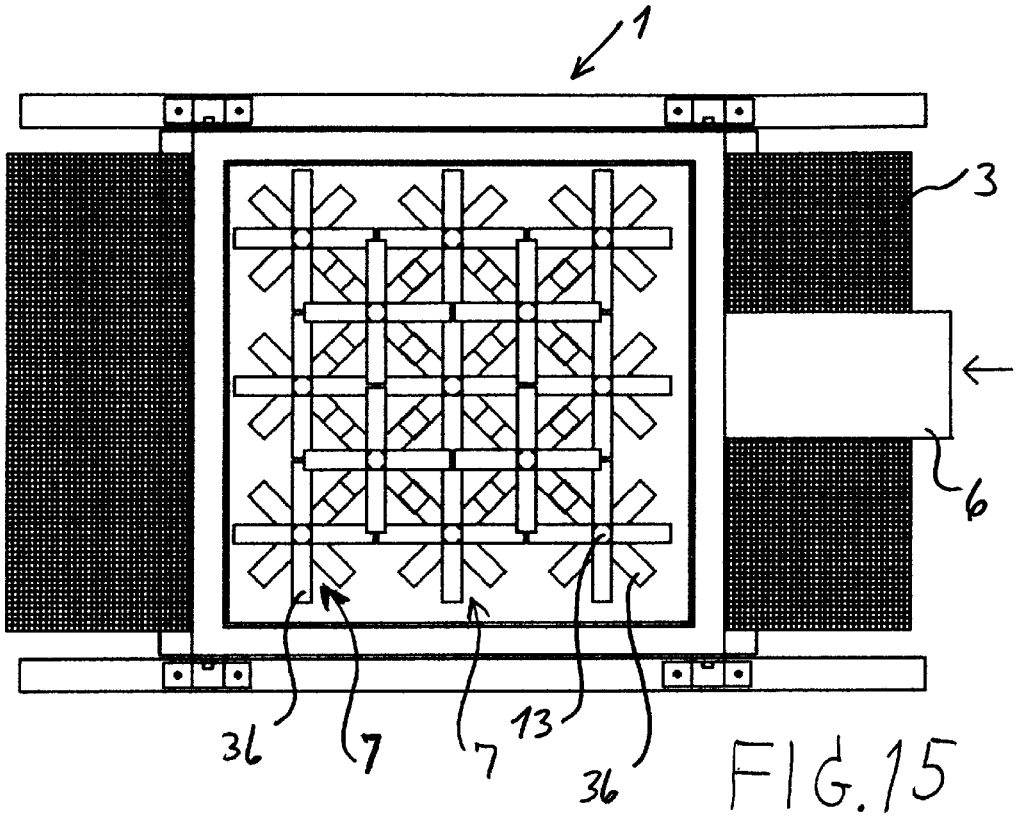
FIG. 15 shows a plane picture with certain parts removed for illustration of a forming box with vertical axles and spikes in form of expanse-formed wings.

In FIGS. 12–15 is illustrated a further embodiment of a forming box 1, in which the rollers 7 are oriented substantially vertically. Hereby the spikes 14 are rotated in planes which are substantially horizontal and principally parallel to the plane of the overside of the forming wire 3. In FIG. 15 alternative orientations are illustrated for the inlet pipes 6. It is, however, to be understood that the forming box 13 can be provided with this one type of inlet pipes or both types of inlet pipes, which can be used alternatively depending on the fibres which are to be introduced into the forming box 1.

In the shown embodiment each of the vertical spike rollers 7 has between three and twelve layers of spikes. These spikes will possibly have a form and size as explained above in connection with the spikes on the horizontal spike rollers 7.

As an alternative, the spike rollers 7 can be established with spikes of a less number of layers and possibly only one single layer. In one embodiment with fewer layers of spikes established along the length of an axle 13 the spikes will preferably be formed as plate-formed wings of the type illustrated in FIGS. 15 and 16.

Figure 12:
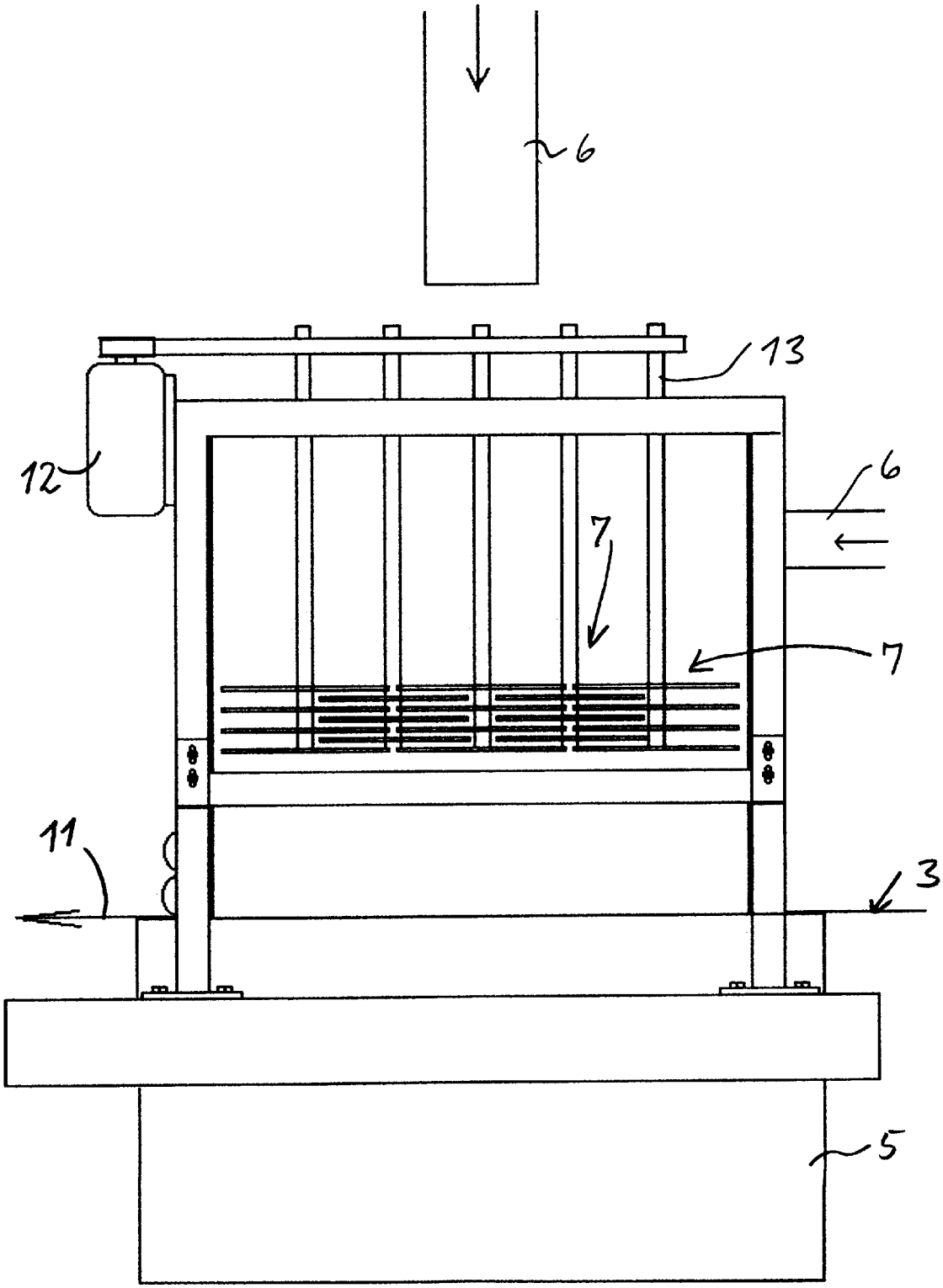
FIG. 12 shows a side picture for illustration of a further embodiment of a forming box according to the invention with vertically oriented rollers.

In FIG. 12 the spikes are formed with a length, so that they exert a substantial overlap between the rollers 7 adjacent to the spikes. In order to assure a problemfree rotation the spikes from adjacent rollers 7 are shifted in relation to each other, so that they rotate in different planes.

In FIG. 13 a situation is illustrated where the spikes have lenghts so that the circumscribed circles approximately touch the circumscribed circles which are formed of spikes 14 from an adjacent roller 7.

In FIG. 14 an embodiment is illustrated in which the spike rollers 7 are provided with spikes which are placed with an inclined angle in relation to a plane perpendicular to the longitudinal direction of the rollers 7. The spikes on the adjacent rollers 7 are alternately oriented with an inclined angle upwards and downwards. Hereby it is possible for the spikes to rotate without colliding with each other. The angle of the orientation of the spikes can be between 0 and 80°, but will preferably be between 30 and 60°.

Figure 16:
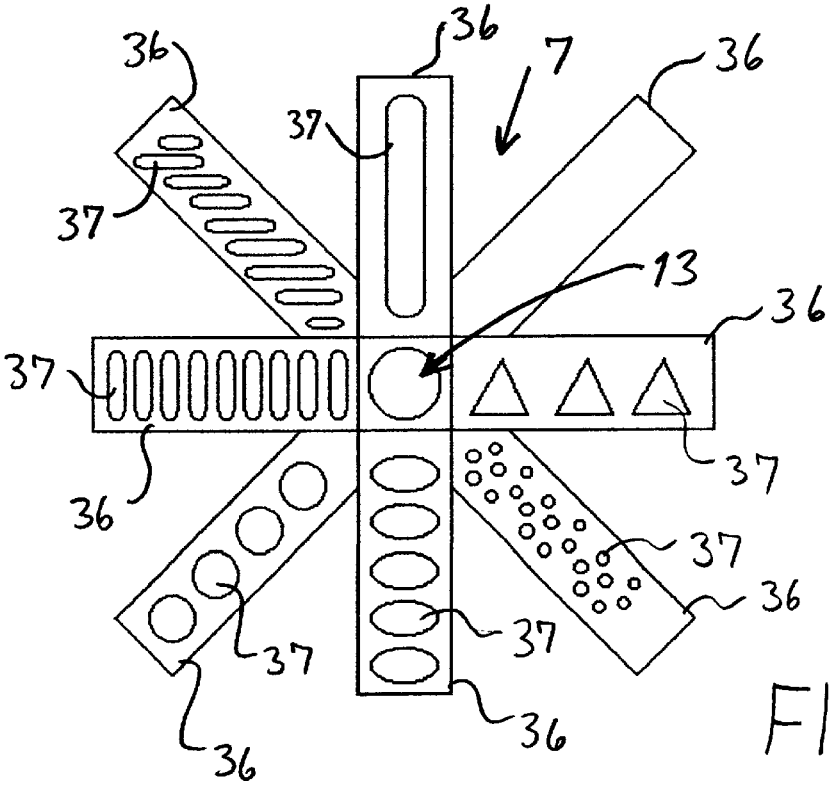
FIG. 16 shows a picture for illustration of plate-formed wings to be used in a forming box, as illustrated in FIGS. 12–15 and illustrated with various embodiments for holes established in the wings.

In FIGS. 15 and 16 an embodiment is illustrated where the spikes are established in form of expanse-formed wings 36, which are mounted on an axle 13. It is preferred that the wings 36 are placed symmetrically around the axle 13. There can be established between two and ten wings in each layer on an axle. In the shown embodiment eight expanse-formed wings 36 are illustrated in each layer. Along an axle there can be established from one to thirteen of such wings. As it appears from FIG. 15 the wings 36 are established with such a radial length that they overlap between wings from adjacent rollers 7. Each layer of wings will therefore be established shifted in relation to each other, for example as illustrated in FIG. 12 or 14.

In FIG. 16 different types of holes 37 are illustrated in the wings 36. Likewise a single wing is illustrated which is not provided with holes. The objection of the holes 37 is to facilitate the passage of air through the forming head. The holes 37 can at the same time be formed so they can be used for steering of the passage of the fibres through the forming head. This can take place by the forming of the size of the holes in combination with the rotation direction. Thus, small holes 37 and a big rotation rate for the wings 36 will make it impossible for the passage of the fibres through the holes 37. Hereby the fibres will be able to pass only down through the forming head by influence from the suction box by passing in-between the wings 36.

In FIGS. 15 and 16 the wings 36 are illustrated as substantially plane wings established in the plane perpendicular to the longitudinal direction of the roller 7. However, they can be inclined to contribute to the stream of air in the forming box. They can thus be inclined to give an upwards or a downwards streaming of air. Alternatively, the wings can be established with different slope to establish turbulent upwards and downwards air streams in the section of the forming head, where the wings 36 are established.

What is claimed is:

1. A forming box for use in dry forming of a fibrous tissue and comprising an inlet for introduction of an up-splitted fibre material, which is chosen among synthetic fibres and natural fibres, and which are mixed up in an air stream, the forming box being positioned above a forming wire opposite to a vacuum box, and the forming box containing several rotating rollers, which are provided with radially extending spikes, characterized in that the forming box is gridless and has an open bottom for delivery of the fibre material onto the forming wire, the spikes being adapted to partly retain the fibres against the influence from the suction of the vacuum box.

2. A forming box according to claim 1, characterized in that the spikes substantially cover an entire sectional area of the forming box as seen in a substantially horizontal plane.

3. A forming box according to the claim 1, characterized in that the rollers are oriented in a substantially horizontally plane.

4. A forming box according to the claims 1 or 2, characterized in that the rollers are oriented in a substantially vertically plane.

5. A forming box according to any of the claims 1–3, characterized in that the rollers are mounted displaceable in a substantially horizontal plane and can be placed with a mutual distance, which approximately corresponds up to, the diameter of a circle, defining the outer ends of the spikes.

6. A forming box according to claim 1, characterized in that a layer of rollers is placed in a row with their longitudinal axes oriented in parallel and perpendicularly to the movement direction of the forming wire.

7. A forming box according to claim 1, characterized in that more layers of rollers are placed above each other, where the rollers in each layer are established with longitudinal axes in the same or different orientation in relation to the rollers in one of the other layers.

8. A forming box according to claim 1 characterized in that the rollers provided with spikes substantially form at least one hollow cylinder, the rollers being established in a cylinder expanse, and the inlet being established for introduction of fibres into the hollow cylinder.

9. A forming box according to claim 8, characterized in that within the cylinder at least one further roller is established, which is provided with spikes, and which is arranged adjacent to the cylinder, so that the diameter of the circle which is defined by the spikes on the rollers, substantially touch each other.

10. A forming box according to claim 8 or 9, characterized in that the cylinders are are in pairs with the inlets established from opposite sides, and that the ends of the cylinders are connected to linking channels, which allow fibres to pass from the inner of a cylinder to the outer of an adjacent cylinder.

11. A forming box according to claim 8, characterized in that the inlets of each cylinder are connected to separate supply sources for fibres for forming of a tissue with varying fibre properties over the thickness.

12. A forming box according to claim 1, characterized in that the spikes are established with substantially plate-formed wings in a plane perpendicular to the longitudinal axis of the rollers.

13. A forming box according to claim 12, characterized in that the plate-formed wings are angled in relation to a plane perpendicular to the longitudinal axis of the roller.

14. A forming box according to claim 12 or 13, characterized in that the wings are provided with holes in order to facilitate passage through the forming box.

15. A forming box according to claim 1, characterized in that the rollers are adapted for being rotated around their longitudinal axes with varying rates and in the varying direction.

16. A forming box according to claim 1, characterized in that the spikes, in the longitudinal direction of the roller, are spaced, which allow the passage in-between for corresponding spikes on an adjacent roller, and that the spikes are placed in a replacement rail being mounted in an axial direction in the roller.

17. A forming box according to claim 1, characterized in that the spikes on each roller are placed in a plane perpendicular to the longitudinal axis of the roller, and that a number of spike sets is established above the length of the roller, and that each set contains 2–12 spikes, and being evenly distributed along the circumference of the roller.

18. A forming box according to claim 1, characterized in that at least an end wall of the forming box, which extends across the forming wire, and which is positioned at an outlet side of the forming box, is adapted for being displaceable in the height direction perpendicular to the underlying forming wire for manufacturing of products with different heights.

19. A forming box according to claim 1, characterized in that the axial distance between the spikes is between 5 and 20 mm and that the thickness of the spikes is between 0.5 and 10 mm and that the length of the spikes is between 5 and 200 mm, and that the rollers are adapted for variable positioning of the number of revolutions in an area between 200 and 5000 r.p.m.

20. A forming box according to claim 1, characterized in that the inlet can be placed in the side walls, the end walls, or the top of the forming box.

* * * * *